US006294902B1

(12) United States Patent
Moreland et al.

(10) Patent No.: US 6,294,902 B1
(45) Date of Patent: Sep. 25, 2001

(54) BANDGAP REFERENCE HAVING POWER SUPPLY RIPPLE REJECTION

(75) Inventors: Carl W. Moreland, Oak Ridge; Marvin J. Young, Greensboro, both of NC (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/637,807

(22) Filed: Aug. 11, 2000

(51) Int. Cl.[7] ..... G05F 1/40; G05F 3/20
(52) U.S. Cl. ..... 323/268; 323/313; 323/314
(58) Field of Search ..... 323/268, 313, 323/314, 312, 266, 281, 289, 273, 539

(56) References Cited

U.S. PATENT DOCUMENTS

| | | | | |
|---|---|---|---|---|
| 4,475,103 | | 10/1984 | Brokaw et al. | 340/501 |
| 4,578,633 | * | 3/1986 | Aoki | 323/315 |
| 4,633,165 | | 12/1986 | Pietkiewicz et al. | 323/314 |
| 4,733,161 | * | 3/1988 | Kuwahara | 323/315 |
| 4,808,908 | | 2/1989 | Lewis et al. | 323/313 |
| 5,095,274 | | 3/1992 | Brokaw | 324/414 |
| 5,291,122 | | 3/1994 | Audy | 323/313 |
| 5,352,973 | | 10/1994 | Audy | 323/313 |
| 5,521,489 | * | 5/1996 | Fukami | 323/313 |
| 5,631,551 | * | 5/1997 | Scaccianoce et al. | 323/313 |
| 5,900,772 | | 5/1999 | Somerville et al. | 327/539 |

OTHER PUBLICATIONS

Alan B. Grebene, *Bipolar and MOS Analog Integrated Circuit Design,* 1984, P.204–209, John Wiley & Sons No Date.

A. Paul Brokaw, *A Simple Three–Terminal IC Bandgap Reference,* IEEE Journal of Solid–State Circuit, vol. SC–9, No. 6, Dec. 1974, pp. 388–393.

Paul R. Gray/Robert O. Meyer, *Analysis and Design of Analog Integrated Circuits,* Third Edition, 1993, John Wiley & Sons, Inc., p.333–347. No Date.

Donald G. Fink, Donald Christiansen, *3rd Edition Electronics Engineers' Handbook,* p. 8–47—8–52. (1989).

* cited by examiner

*Primary Examiner*—Rajnikant B. Patel
(74) *Attorney, Agent, or Firm*—Koppel & Jacobs

(57) ABSTRACT

A bandgap reference circuit provides an output reference voltage that is generally insensitive to fluctuations in supply voltage, ambient temperature, and output load current. A current regulator establishes an output whose variations are reduced, preferably logarithmically, relative to variations in a supply voltage. A bandgap generator fed by the output current provides an output reference voltage with similarly suppressed variations. A control amplifier biases the bandgap generator to provide a high level common-mode rejection of various error sources.

14 Claims, 3 Drawing Sheets

BANDGAP REFERENCE HAVING POWER SUPPLY RIPPLE REJECTION

BACKGROUND OF THE INVENTION

1. Field of the Invention

This invention relates to bandgap voltage references, and more specifically to bandgap voltage reference circuits with high power supply ripple rejection.

2. Description of the Related Art

In the design of various analog circuits, such as digital to analog converters, voltage regulators, or low drift amplifiers, it is necessary to establish an independent bias reference within the circuit. This stable bias reference can be either a current or a voltage. In most applications, voltage rather than current references are preferred since they are easier to interface with the rest of the circuitry. Voltage references are required to provide a substantially constant output voltage regardless of changes in input voltage, output current, or temperature.

Temperature-compensated bias references are described in a number of publications, including an article by Paul Brokaw, "A Simple Three-Terminal IC Bandgap Reference," IEEE Journal of Solid-State Circuits, Vol. SC-9, No. 6, December 1974, PP 388–393, and in Grebene, *Bipolar and MOS Analog Integrated Circuit Design,* John Wiley & Sons, 1984 PP 204–209. In designing temperature-compensated bias references, one starts with a predictable temperature drift, and then finds another predictable temperature source with temperature drift in the opposite direction that can be scaled by a temperature independent scale factor. Then, by proper circuit design, the effects of the two opposite-polarity drifts are made to cancel, resulting in a nominally zero temperature coefficient voltage level.

Three basic temperature drift sources exist that are reasonably predictable and repeatable. The first is the temperature dependence of a bipolar transistor base-emitter voltage drop VBE that exhibits a strong negative temperature coefficient, typically about −2 mV/° C. The second is the temperature dependence of the $V_{BE}$ difference $\Delta V_{BE}$ between two transistors, which is proportional to absolute temperature through the thermal voltage $V_T$ and thus exhibits a positive temperature coefficient. The third and last temperature drift source is that of the base-emitter voltage of a Zener diode $V_Z$, which is inherently low and positive in polarity.

By scaling one or more of these drift sources and subtracting them from each other, one may achieve the required compensation to provide a temperature independent bias voltage. Most voltage references are generally based on either Zener diodes or bandgap generated voltages. Zener devices characteristically exhibit high power dissipation and poor noise specifications. Bandgap generated voltage references compensate the negative $V_{BE}$ temperature drift with the positive thermal voltage temperature coefficient of $V_T$, with $V_T$ equal to kT/q, where k is Boltzmann's constant, T is the absolute temperature in degrees Kelvin and q is the electron charge.

In a simplified model, the output reference voltage $V_{out}$ may be expressed as:

$$V_{out}=V_{BE}+KV_T. \quad (1)$$

Since the two terms in the above equation exhibit opposite-polarity temperature drifts, it should be possible, at least in theory, to make $V_{out}$ nominally independent of temperature. A temperature-stabilized output dc level, in which $\partial V_{out}/\partial T$ is nominally equal to zero, is realized at an output voltage level on the order of +1.25V, which is very near the bandgap voltage of silicon. The name bandgap reference is derived from this relationship. Numerous variations in the bandgap reference circuitry have been designed, and are discussed for example in the U.S. Pat. Nos. 5,352,973 and 5,291,122 to Audy, assigned to Analog Devices, Inc., the assignee of the present invention.

A voltage reference, in addition to being temperature independent, also ideally applies a substantially constant output voltage irrespective of changes in input voltage supply or output current. These changes create signal noise (ripple) which degrades the overall stability of the voltage output, and should be rejected. The degree of rejection is called the high power supply ripple rejection (PSR). Known bandgap references generally fail to supply a substantially constant output reference voltage.

SUMMARY OF THE INVENTION

The present invention seeks to provide a bandgap reference circuit that is generally insensitive to variations in ambient temperature, input voltage, and output current.

These goals are accomplished by interfacing a current regulator between the voltage supply and a voltage reference circuit. The current regulator generates a regulated output current with reduced fluctuations with respect to variations in the supply voltage and the output load current. The voltage reference circuit operates from the regulated current to produce a stabilized bandgap reference voltage.

The current regulator preferably produces an output current which varies logarithmically with respect to variations in the supply voltage. The voltage reference circuit preferably includes a control amplifier that biases a bandgap generator, and provides a high level common-mode rejection of various error sources in the circuit. The current regulator preferably includes a pnp bipolar transistor that generates a transistor voltage with logarithmically reduced variations compared to the voltage supply.

These and other features and advantages of the invention will be apparent to those skilled in the art from the following detailed description of preferred embodiments, taken together with the accompanying drawings, in which:

DETAILED DESCRIPTION OF THE INVENTION

Figure 1:
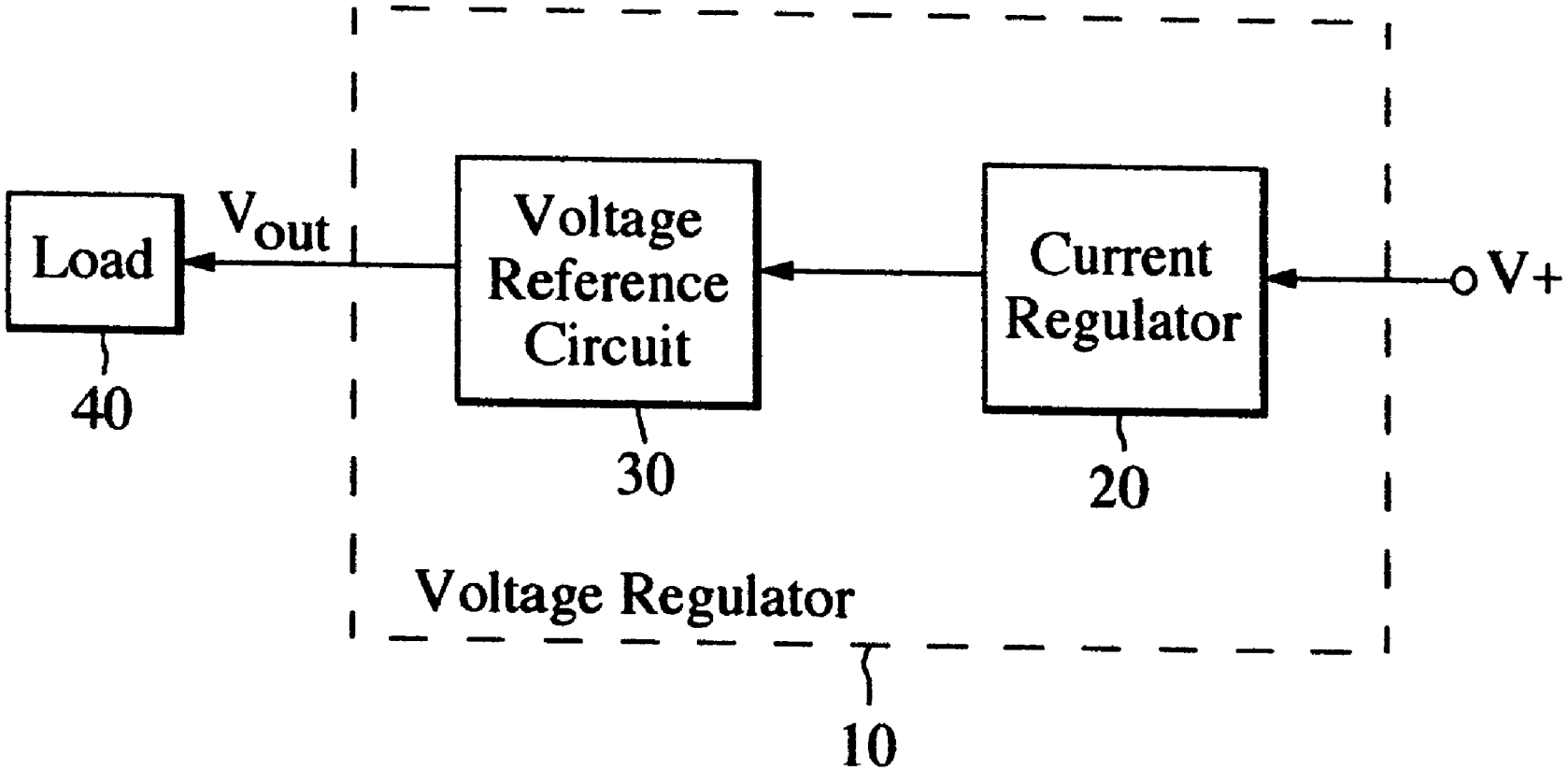
FIG. 1 is a block diagram illustrating a voltage regulator in accordance with the invention.

A block diagram of a circuit for implementing the invention is shown in FIG. 1, which includes a voltage regulator 10 powered from a power supply terminal V+. Terminal V+ typically receives a nominal supply voltage of about 5.0 volts. The voltage regulator 10 comprises a current regulator 20 that delivers a regulated output current to a voltage reference circuit 30. The regulated current has logarithmically reduced variations compared to changes in the input voltage supply. The reference circuit 30 produces a reference voltage $V_{out}$ to supply a load 40. The reduced current ripple provided as an input to the voltage reference circuit 30 reduces any variations in $V_{out}$.

Figure 2:
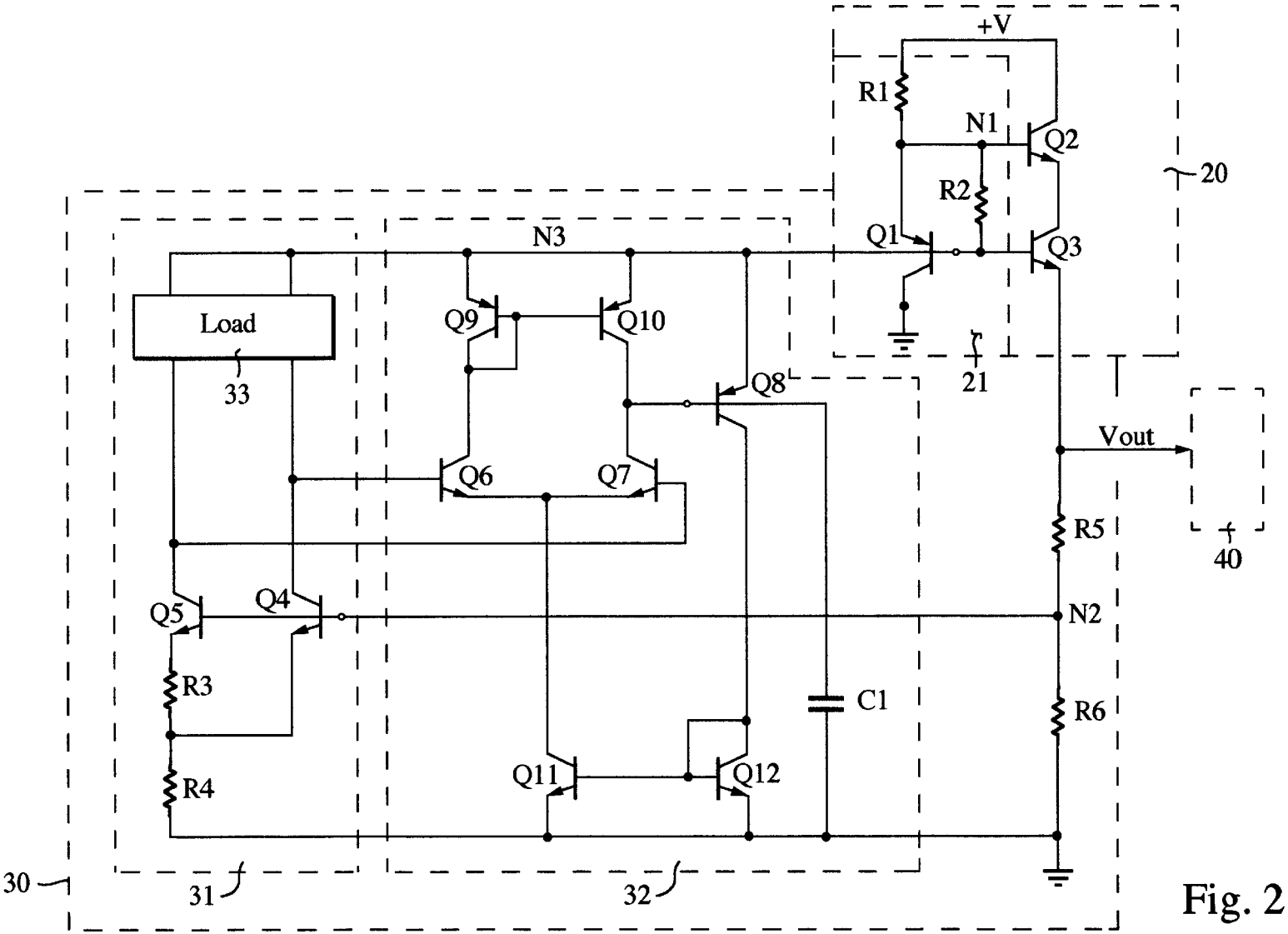
FIG. 2 is a simplified schematic diagram of a current regulator and a voltage reference that can be used in the voltage regulator of FIG. 1.

A current regulator 20 that can be used in the circuit of FIG. 1 is illustrated in FIG. 2. It comprises a current generator that receives a supply voltage from the voltage supply terminal V+ and outputs a regulated current to the voltage reference circuit 30. The current generator is comprised of a pnp bipolar transistor Q1 whose emitter is connected to V+ through a resistor R1 and to its base through another resistor R2, with its collector connected to ground. The V+ voltage establishes a variable emitter current $I_{E1}$ for Q1. Large variations in this current are possible due to fluctuations in the voltage supply. The fluctuating current $I_{E1}$ generates a logarithmically varying voltage $V_{BE1}$ across the emitter-base junction of the transistor Q1, expressed as:

$$V_{BE1}=V_T*ln(I_{E1}/I_s). \quad (2)$$

$V_T$ represents the thermal voltage of approximately 26 mV at 300 K°), and $I_s$ is the transistor saturation current. Since the emitter-base junction of Q1 and the resistor R2 are connected in parallel, $V_{BE1}=V_{R2}$, where $V_{R2}$ is the voltage across R2. The logarithmically varying voltage $V_{BE1}$ in equation (2), divided by the impedance of resistor R2, yields the current $I_{R2}$ as follows:

$$I_{R2}=V_{BE1}/R2. \quad (3)$$

This logarithmically varying current, with logarithmic reductions in current fluctuations with respect to variations in input voltage supply V+ (except for second order base currents), is output to the voltage reference circuit 30.

The voltage regulator circuit 30, includes a bootstrap transistor Q2, which has its base connected to the node N1 at the junction of R1, R2 and the collector of Q1, its collector to V+, and its emitter connected to the collector of a buffer output transistor Q3. The bootstrap Q2 prevents collector-base modulations of Q3 due to supply ripple. The transistor Q3 has its emitter connected to the output $V_{out}$ of the voltage regulator 10, and its base to resistor P2 and the base of Q1. The buffer circuit isolates the current $I_{R2}$ from the effects of load impedance variations at $V_{out}$. The current regulator 20 therefore outputs to a node N3 an output current that is substantially equal to $I_{R2}$ (since the current drawn from N3 into the base of Q3 is substantially offset by the base current flowing from N3 out to Q1), and exhibits fluctuations that are logarithmically reduced relative to variations in the supply voltage V+, as well as insensitive to the output load current.

While the current regulator 20 significantly improves supply ripple rejection, additional improvement comes from a biasing scheme used in the voltage reference circuit 30, which is also illustrated in FIG. 2. This circuit includes a well known bandgap generator circuit 31, which has numerous possible designs as discussed in a number of publications, including U.S. Pat. Nos. 4,475,103 and 4,808,908 to Brokaw and Lewis et al., both assigned to Analog Devices, Inc., the assignee of the present invention. The bandgap reference circuits were developed to provide a stable voltage supply that is insensitive to temperature variations over a wide temperature range. In the example shown, the bandgap generator circuit 31 includes common base connected bipolar npn transistors Q4 and Q5, with the emitter area of Q5 scaled larger than that of Q4 by a factor N. A resistor P3 is connected across the emitters of Q4 and Q5, while a tail resistor R4 is connected from R3 to a low return voltage reference, preferably ground. The collectors of Q4 and Q5 are also connected to the output of current regulator 20, through a load 33. A bandgap reference voltage $V_{ref}$ is provided at node N2, which is connected to the bases of transistors Q4 and Q5. With proper resistor trimming, $V_{ref}$ equals the bandgap voltage for the material from which the circuit is formed. The bandgap voltage can vary with the particular process used to fabricate the circuit; for silicon, it is typically in the approximate range of 1.17–1.19V.

By designing the circuit to stabilize $V_{ref}$ at the bandgap voltage, the ultimate voltage output $V_{out}$ may be stabilized at a higher voltage. This is preferably accomolished with a simple resistive voltage divider circuit consisting of resistors R5 and R6 connected in series between $V_{out}$ and ground, with node N2 between R5 and R6. The output voltage $V_{out}$ may be set to any convenient value, and is expressed as:

$$V_{out}=V_{ref}(1+R_5/R_6). \quad (4)$$

The voltage reference circuit 30 also includes a control amplifier 32 that establishes equal collector voltages for Q4 and Q5. It is comprised of a dual transistor differential amplifier Q6/Q7 that has its non-inverting input (the base of Q6) and its inverting input (the base of Q7) connected to the collectors of Q4 and Q5, respectively. The differential amplifier amplifies any differences between the signals at its input terminals, causing a pnp transistor Q8, whose base is connected to the collector of Q7, to sink current from current regulator output node N3 to maintain equal collector voltages for Q6/Q7, and thereby Q4/Q5. Process spreads, ambient temperature, and supply ripple are among many factors that may generate collector voltage imbalances between Q4 and Q5.

The control amplifier 32 further includes two current mirror transistor pairs Q9–Q10 and Q11–Q12 to balance any residual imbalances within it. The emitters of Q9–Q10 are connected to each other at node N3, their collectors are connected respectively to the collectors of the differential amplifier transistors Q6 and Q7, and the base of Q9 is shorted to its collector in a diode configuration. Matching transistors Q9 and Q10 causes Q10 to carry a current equal to the collector current of Q6 ($I_{CQ6}$), ignoring second order base currents. Transistors Q6–Q7 and Q9–Q10 form a differential-to-single-ended converter. Current mirror Q11–Q12 forces the emitter drive current to the Q6/Q7 differential amplifier to equal the collector current sunk by Q8. Together with Q3, R5 and R6, the control amplifier 32 establises a feedback circuit that drives the collector voltages of Q6/Q7, and thus the collector voltages of Q4/Q5, towards equality.

Without the Q11/Q12 mirror, the base-emitter voltage $V_{BE8}$ for Q8 would vary logarithmically with changes in $I_{R2}$. Any variation in $V_{BE8}$ generates corresponding variations in the voltages at the collectors of transistors Q10 and Q7, which imbalances the differential amplifier, causing an output error. The differential amplifier becomes unbalanced because the collector voltages of Q6 and Q9 no longer equal those of Q7 and Q10. However, the current mirror transistors Q11/Q12 cause $I_{CQ6}$ to change exactly like $I_{Q8}$, generating equal collector voltages for Q6–Q7. Oscillations that might occur at the Q8 output of the differential amplifier are mostly dampened by a capacitor C1 that is connected to the base of Q8.

Figure 3:
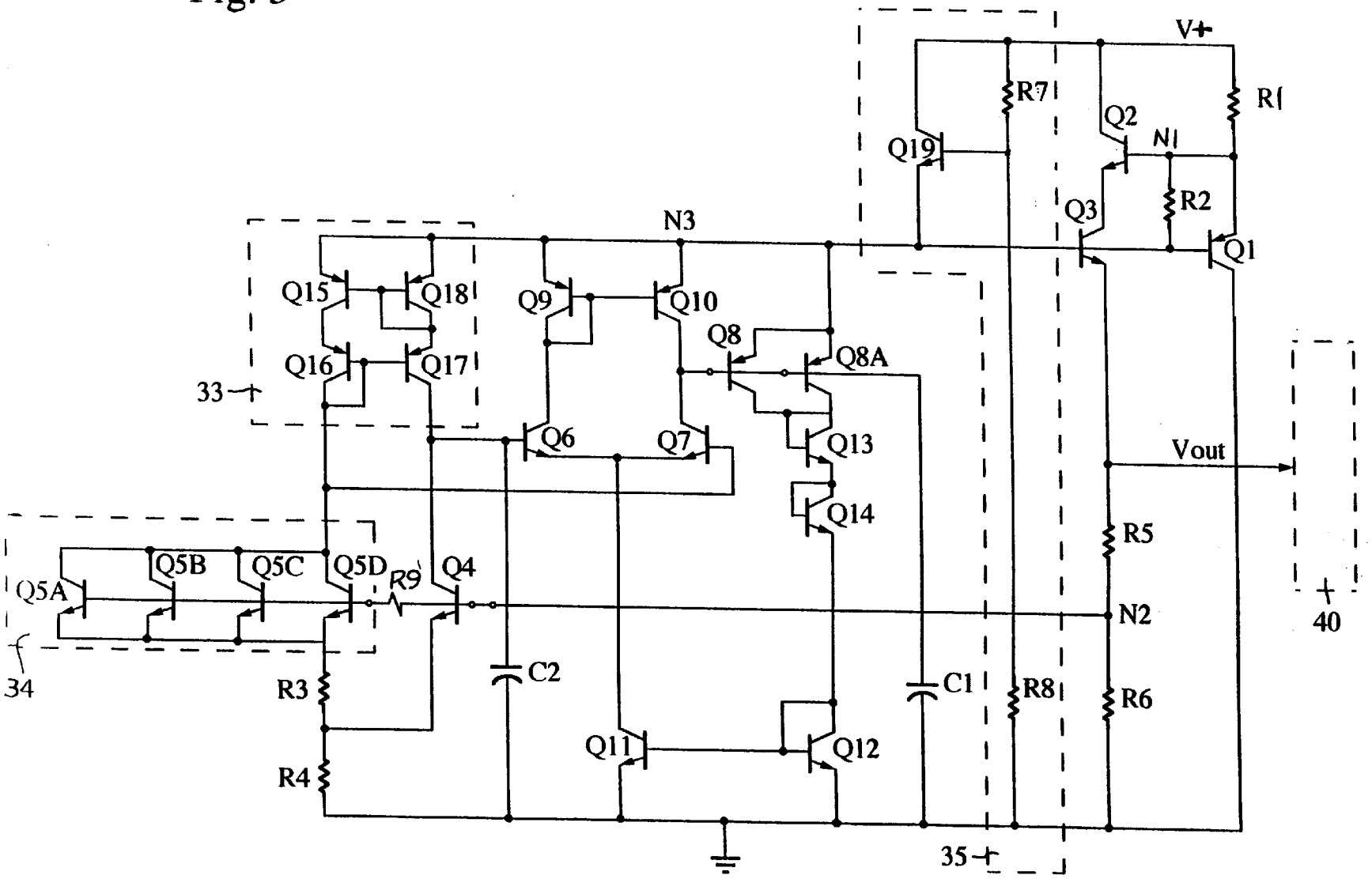
FIG. 3 is a more detailed schematic diagram of the voltage reference shown in FIG. 2.

With the arrangement described, the current density through Q8 differs from that through Q9 and Q10 because Q6 and Q7 evenly divide the current mirrored in Q11. In addition, the base-collector voltage of Q8 with a non-zero value is unequal to those of Q9 to Q12, which equal zero. FIG. 3 illustrates additional circuitry for reducing these differences. An additional equal area transistor Q8A is connected parallel to Q8 to reduce the current flow through Q8 by half, making the current densities through Q6 to Q10 more equal; doubling the emitter size of Q8 would have an equivalent effect. Two additional diode-connected transistors Q13 and Q14 are connected in series with the common collector connection for Q8–Q8A to lower the base-collector voltage of Q8, setting it approximately equal to the base-collector voltages of Q9 to Q12. A second capacitor C2 is connected to the base of Q6 to dampen any oscillation that might occur at the input of the differential amplifier. The described biasing scheme substantially equalizes any current fluctuations in the control amplifier 32, resulting in a high level common-mode rejection of various possible error sources.

Also shown in the circuit of FIG. 3 are conventional details of both the current mirror 33 and a preferred implementation for Q5 in the bandgap generator 31. Mirror 33 is shown as a dual mirror, with a first mirror Q16/Q17 (Q16 diode-connected) feeding a second mirror Q17/Q18 (Ql8 diode-connected). The emitter area of Q5 is effectively quadrupled by implementing it as four equal-area parallel transistors Q5A–Q5D. Also illustrated is a conventional starter circuit 35 that enables the activation of the entire unit. It is comprised of a transistor Q19 which has its collector connected to V+, its emitter to node N3, and its base to the junction of series connected resistors R7 and R8 in a voltage divider circuit between V+ and ground. When a voltage is supplied at V+, half of its value (assuming equal resistive values for R7 and R8) instantaneously appears at the base of Q19 to pull-up the Q19 emitter voltage, activating the rest of the circuit. When the Q19 emitter voltage rises to less than a diode drop below its base voltage, the base-emitter voltage $V_{BEQ19}$ becomes zero to shutoff Q19. Hence, after the starter circuit 35 activates the entire unit, it automatically shuts itself off.

While illustrative embodiments of the invention have been described, numerous variations and alternate embodiments will occur to those skilled in the art. For example, it may be possible to use voltage controlled transistors such as, for example, field effect transistors (FETs) with appropriate biasing schemes, for some of the illustrated current controlled bipolar junction transistors (BJTs). Such variations and alternate embodiments are contemplated, and can be made without departing from the spirit and scope of the invention as defined in the appended claims.

We claim:

1. A voltage regulator that provides a regulated output voltage, comprising:

a current regulator that provides a regulated current;

a bandgap reference generator that includes first and second transistors which respectively have first and second current terminals that respectively respond to coupled first and second control terminals wherein said bandgap reference generator receives a first portion of said regulated current and generates a reference voltage on said coupled first and second control terminals;

a control amplifier that receives a second portion of said regulated current and varies the magnitude of said second portion in response to a voltage difference between said first and second current terminals; and a buffer output circuit that receives a third portion of said regulated current, provides said regulated output voltage and couples a portion of said regulated output voltage to said coupled first and second control terminals.

2. The voltage regulator of claim 1, wherein said current regulator includes:

a current resistor that carries said regulated current; and a regulator transistor that has a regulator control terminal and a regulator current terminal that responds to said regulator control terminal wherein said regulator control terminal is coupled to one end of said current resistor and said regulator current terminal is coupled to another end of said current resistor to thereby realize said regulated current.

3. The voltage regulator of claim 1, wherein said first and second transistors respectively have third and fourth current terminals that respectively respond to said coupled first and second control terminals and said bandgap reference generator further includes:

a tail resistor coupled to said fourth current terminal; and a second resistor coupled between said third and fourth current terminals.

4. The voltage regulator of claim 1, wherein said bandgap reference generator further includes a current mirror coupled between said first and second current terminals.

5. The voltage regulator of claim 1, wherein said control amplifier includes:

a differential pair of transistors that generates a difference current in response to said voltage difference; and a control transistor that varies said magnitude of said second portion in response to said difference current.

6. The voltage regulator of claim 5, wherein said control amplifier further includes a current mirror that provides a tail current to said differential pair in response to said control transistor.

7. The voltage regulator of claim 1, wherein said buffer output circuit includes:

a voltage divider; and a buffer transistor that receives a fourth portion of said regulated current and is coupled to said voltage divider to generate said regulated output voltage;

and wherein said voltage divider is coupled to provide said portion of said regulated output voltage to said coupled first and second control terminals.

8. A voltage regulator that provides a regulated output voltage, comprising:

a current regulator that provides a regulated current;

a bandgap reference generator that includes first and second transistors which respectively have first and second current terminals that respectively respond to coupled first and second control terminals wherein said bandgap reference generator receives a first portion of said regulated current and generates a reference voltage on said coupled first and second control terminals; and a feedback circuit that generates said regulated output voltage and couples a portion of said regulated output voltage to said coupled first and second control terminals in response to a difference voltage between said first and second current terminals wherein said feedback circuit includes:

a) a control amplifier that receives a first portion of said regulated current and varies said first portion in response to said difference voltage;

b) a voltage divider; and c) a buffer transistor that receives a second portion of said regulated current and drives said voltage divider to generate said regulated output voltage across said voltage divider and couple a portion of said regulated output voltage from said voltage divider to said coupled first and second control terminals.

9. The voltage regulator of claim 8, wherein said current regulator includes:

a first resistor that carries said regulated current;

a regulator transistor having a regulator control terminal coupled to one end of said first resistor and a regulator current terminal that responds to said regulator control terminal coupled to another end of said first resistor; and a second resistor that couples said first resistor to a supply voltage.

10. The voltage regulator of claim 8, wherein said current regulator includes:

a regulator transistor having a regulator control terminal and a regulator current terminal that responds to said regulator control terminal wherein said regulator current terminal is coupled to a supply voltage; and a first resistor that is coupled between said regulator control terminal and said regulator current terminal to receive said regulated current.

11. The voltage regulator of claim 8, wherein said control amplifier comprises:

a differential amplifier that responds to said voltage difference; and a control transistor that receives a said second portion of said regulated current and varies said magnitude of said second portion in response to said differential amplifier.

12. The voltage regulator of claim 11, wherein said differential amplifier is a differential pair of transistors and said control amplifier further includes a first current mirror that provides a tail current to said differential pair in response to said control transistor.

13. The voltage regulator of claim 12, wherein said control amplifier further comprises a second current mirror that couples a fourth portion of said regulated current to said differential pair.

14. The voltage regulator of claim 12, wherein said voltage divider comprises first and second serially-connected resistors.

* * * * *